US009603476B2

(12) United States Patent
Carman et al.

(10) Patent No.: US 9,603,476 B2
(45) Date of Patent: Mar. 28, 2017

(54) METHOD FOR PULLING A BUTTON THROUGH A BUTTON HOLE

(71) Applicants: Billy Carman, Buffalo, NY (US); William Przysinda, Buffalo, NY (US)

(72) Inventors: Billy Carman, Buffalo, NY (US); William Przysinda, Buffalo, NY (US)

( * ) Notice: Subject to any disclaimer, the term of this patent is extended or adjusted under 35 U.S.C. 154(b) by 0 days.

(21) Appl. No.: 14/796,200

(22) Filed: Jul. 10, 2015

(65) Prior Publication Data

US 2017/0007056 A1 Jan. 12, 2017

(51) Int. Cl.
*A47G 25/92* (2006.01)

(52) U.S. Cl.
CPC ..... *A47G 25/92* (2013.01); *Y10T 24/17* (2015.01)

(58) Field of Classification Search
CPC ..... A47G 25/92
USPC ..... 24/40, 3.13, 300, 301, 302, 114.11, 299
See application file for complete search history.

(56) References Cited

U.S. PATENT DOCUMENTS 108,063 A * 10/1870 Stevens ..... A45F 5/02 24/299
208,435 A * 9/1878 Stevens ..... A47G 25/92 24/40
342,643 A * 5/1886 Sellman ..... B25B 13/28 24/40
358,118 A * 2/1887 Hodge ..... A47G 25/92 24/40
416,932 A * 12/1889 Mabie ..... A47G 25/92 24/40
424,683 A * 4/1890 Murray ..... A47G 25/92 24/40
429,661 A * 6/1890 Sullivan ..... A47G 25/92 24/40
508,745 A * 11/1893 Paul ..... D05B 85/00 100/1
511,534 A * 12/1893 Latham et al. ..... A47G 25/92 24/40
518,619 A * 4/1894 Muir ..... A47G 25/92 24/40
684,915 A * 10/1901 Crandall ..... A47G 25/92 24/40
686,325 A * 11/1901 O'Connor ..... A47G 25/92 24/40
691,853 A * 1/1902 Freck ..... A47G 25/92 24/40
754,842 A * 3/1904 Blais ..... A41D 25/02 2/148
901,248 A * 10/1908 Melnick ..... A47G 25/92 24/40
979,342 A * 12/1910 Ayers, Jr. ..... A47G 25/92 24/40
1,074,649 A 10/1913 Schwery
1,098,532 A 6/1914 Schreiner
(Continued)

*Primary Examiner* — Robert J Sandy
*Assistant Examiner* — Jason W San

(57) ABSTRACT

A method for pulling a button through a buttonhole includes a shirt with a button and a buttonhole wherein the button and the buttonhole define a mated coupler. A clamp engages the button and a tether is attached to the clamp. The clamp is extended through the buttonhole and the button is engaged with the clamp while the tether extends through the buttonhole. The clamp and the button are pulled through the buttonhole and the button is released from the clamp.

5 Claims, 3 Drawing Sheets

(56) References Cited

U.S. PATENT DOCUMENTS 1,101,557 A * 6/1914 Lister ..... A47G 25/92 24/40
1,207,522 A * 12/1916 Fewell ..... A47G 25/92 24/40
1,355,176 A * 10/1920 Smolarski ..... A47G 25/92 24/40
1,423,782 A * 7/1922 Szigethy ..... A47G 25/92 24/40
1,461,834 A * 7/1923 Smiley ..... A47G 25/88 223/113
1,922,594 A * 8/1933 Lippstadt ..... A45D 31/00 24/299
2,042,808 A * 6/1936 Seebeck ..... A44C 19/00 24/115 H
2,115,545 A * 4/1938 Yumont ..... A47G 25/92 223/111
2,216,469 A * 10/1940 Fischer ..... B25B 27/22 24/40
2,764,797 A * 10/1956 Carson ..... A44C 7/00 24/299
2,912,733 A 11/1959 Layman
3,112,491 A * 12/1963 Cleveland ..... A41F 1/00 2/88
3,683,459 A * 8/1972 Johansen ..... A44B 3/00 24/40
D240,669 S 7/1976 Pifer
3,968,669 A * 7/1976 Coleman ..... A45C 11/32 24/299
4,471,509 A * 9/1984 Marks ..... A44C 15/0055 24/115 H
4,942,646 A * 7/1990 Sebastian ..... A47G 25/92 24/40
5,168,605 A * 12/1992 Bartlett ..... A47C 21/022 24/129 R
5,235,730 A * 8/1993 Townsend ..... A44B 6/00 24/3.13
5,276,948 A 1/1994 Steadman
5,542,156 A * 8/1996 Oglesby ..... A41F 17/04 2/233
5,615,454 A * 4/1997 Contarino ..... A45C 13/20 24/116 A
5,855,401 A * 1/1999 Papernik ..... A47G 25/901 24/40
8,245,358 B2 * 8/2012 Lo ..... A61J 17/00 24/3.13
2006/0135039 A1 * 6/2006 Fildan ..... A41F 15/002 450/82
2007/0151082 A1 7/2007 Stedje
2015/0265005 A1 * 9/2015 Potterbaum ..... A44B 5/00 223/2
2016/0143399 A1 * 5/2016 Neri ..... A47G 25/92 24/40

* cited by examiner

METHOD FOR PULLING A BUTTON THROUGH A BUTTON HOLE

BACKGROUND OF THE DISCLOSURE

Field of the Disclosure

The disclosure relates to button coupling assisting devices and more particularly pertains to a new button coupling assisting device for assisting a person in buttoning a shirt.

SUMMARY OF THE DISCLOSURE

An embodiment of the disclosure meets the needs presented above by generally comprising a shirt including a button and a buttonhole wherein the button and the buttonhole define a mated coupler. A clamp engages the button and a tether is attached to the clamp. The clamp is extended through the buttonhole and the button is engaged with the clamp while the tether extends through the buttonhole. The clamp and the button are pulled through the buttonhole and the button is released from the clamp.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
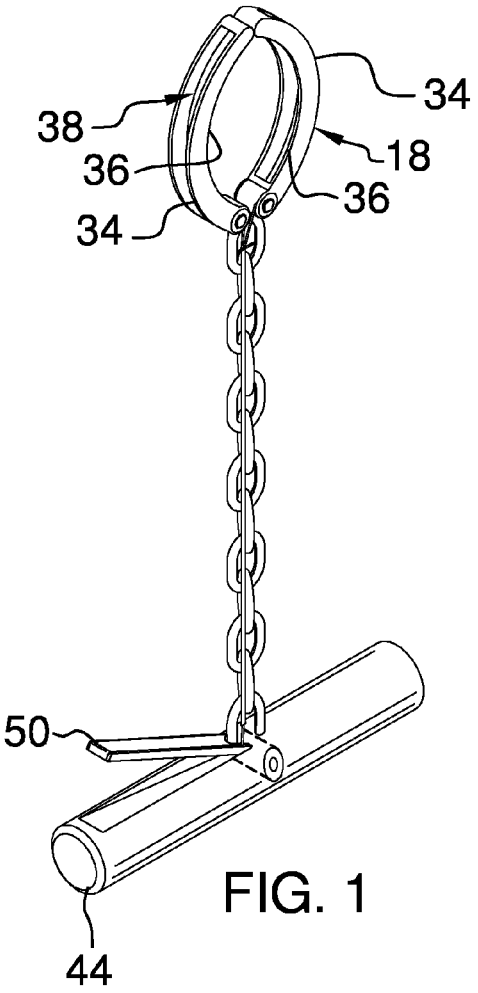
FIG. 1 is a perspective view of a method for pulling a button through a buttonhole according to an embodiment of the disclosure.
Figure 2:
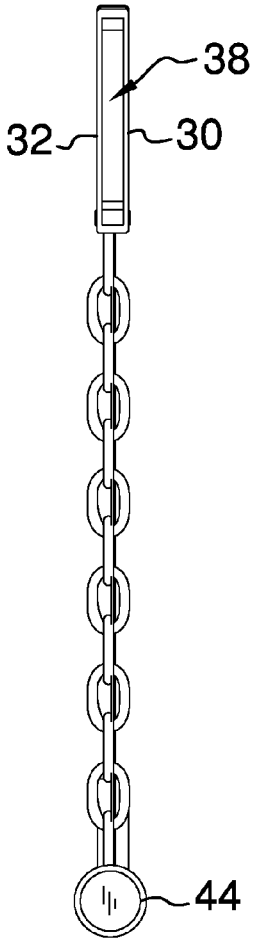
FIG. 2 is a side view of an embodiment of the disclosure.

With reference now to the drawings, and in particular to FIGS. 1 through 5 thereof, a new button coupling assisting device embodying the principles and concepts of an embodiment of the disclosure and generally designated by the reference numeral 10 will be described.

Figure 3:
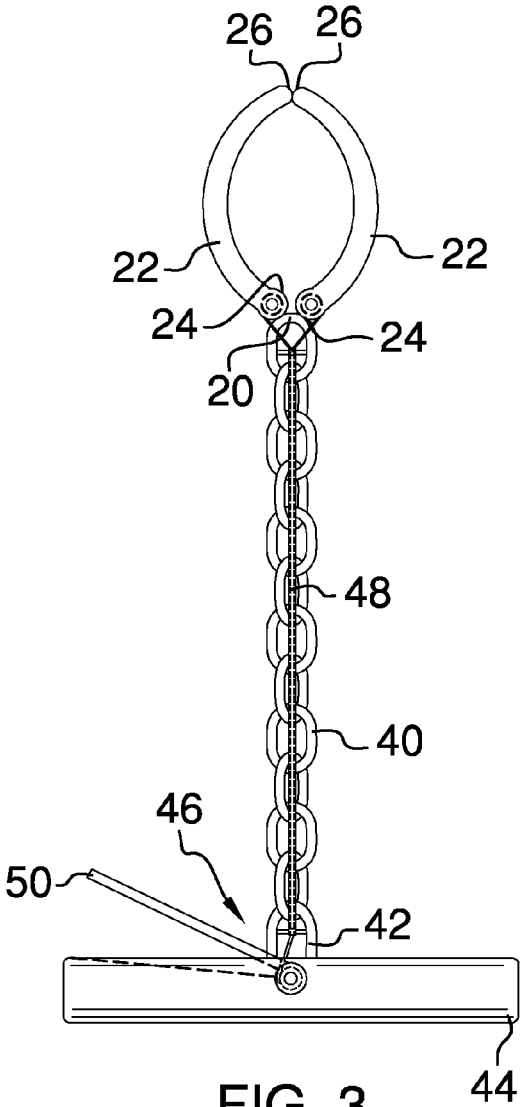
FIG. 3 is a front view of an embodiment of the disclosure.
Figure 4:
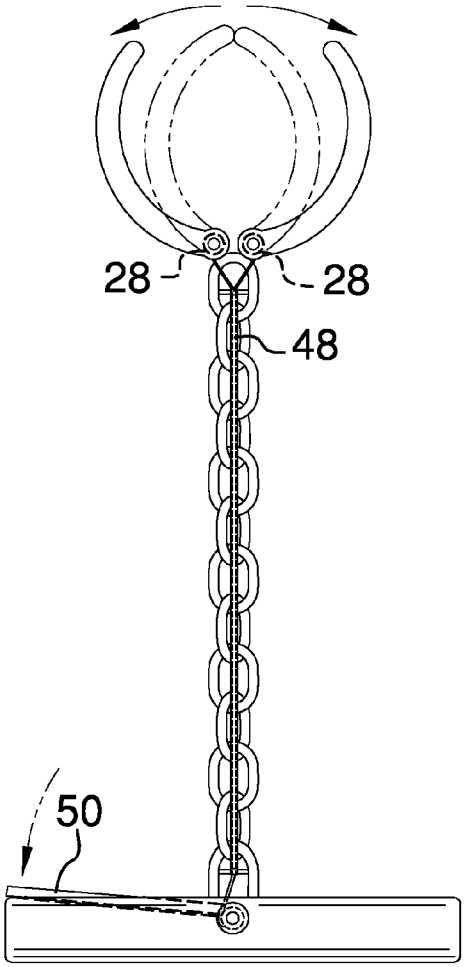
FIG. 4 is a front view of an embodiment of the disclosure.
Figure 5:
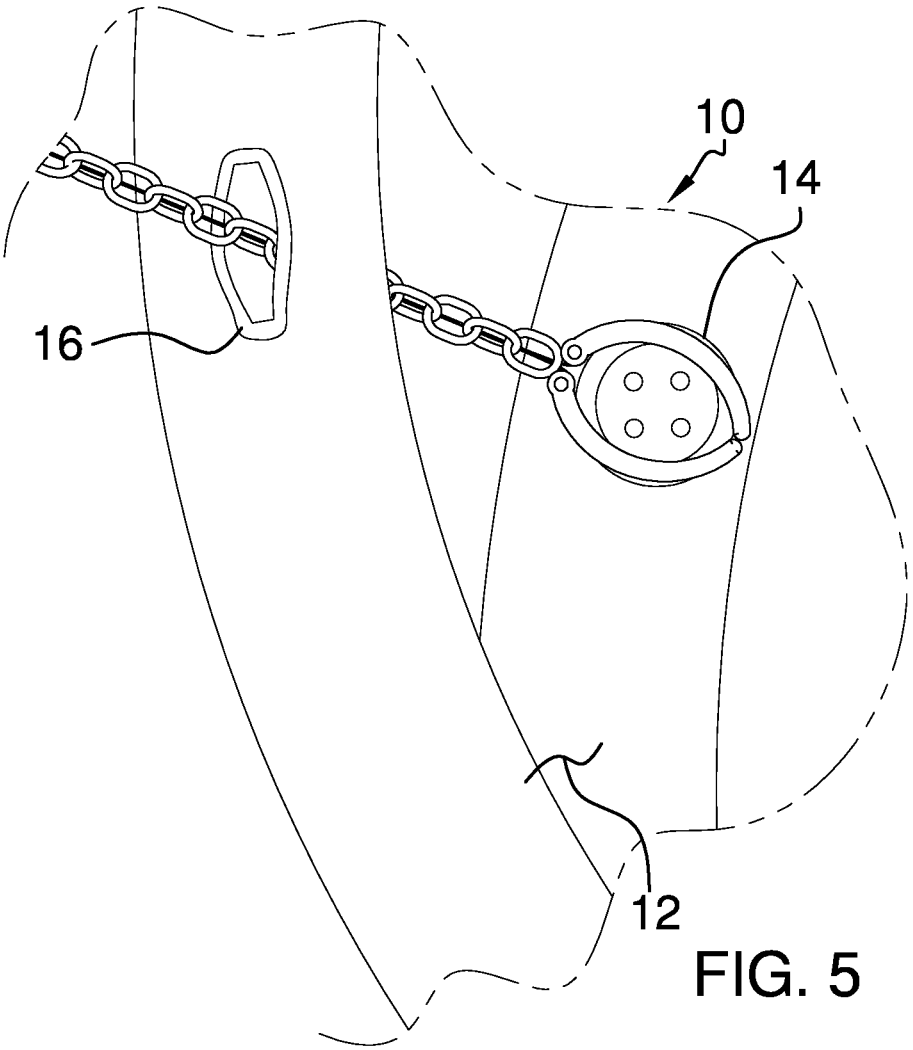
FIG. 5 is an in-use view of an embodiment of the disclosure.

As best illustrated in FIGS. 1 through 5, the method for pulling a button through a buttonhole 10 generally comprises providing a conventional shirt 12, only a portion of which is shown in FIG. 5, including a button 14 and a buttonhole 16 wherein the button 14 and the buttonhole 16 define a mated coupler for closing a shirt or cuff. Such shirts 12 will typically have a plurality of buttons 14 and buttonholes 16.

A clamp 18 is provided which is configured for engaging the button 14. The clamp 18 includes a base 20 and a pair of jaws 22 wherein each of the jaws 22 has a first end 24 and a second end 26. Each of the first ends 24 is pivotally coupled to the base 20 and each of the second ends 26 is movable towards or away from each other. The jaws 22 each have an arcuate shape extending from the first end 24 to the second end 26 such that the jaws 22 form a closed loop when the second ends 26 are abutted against each other as is shown in FIG. 3. The second ends 26 are biased towards each other. This may be done in any conventional manner such as including springs 28 which engage the jaws 22 and bias them toward each other, though the jaws 22 may not be biased towards each other. Each of the jaws 22 includes a first side 30, a second side 32, an outer edge 34 and an inner edge 36. The outer edges 34 each have an elongated slot 38 therein extending through the inner edges 36. The slots 38 are configured to receive the button 14 as shown in FIG. 5. The slots 38 have a width between 0.1 inches and 0.2 inches so that the button 14 may be extended into the slots 38 and the jaws 22 securely engage the button 14.

A tether 40 is attached to the clamp 18. The tether 40 has a distal end 42 with respect to the clamp 18. The tether 40 may comprise a linked chain or other bendable tether. A handle 44 is attached to the distal end 42. The handle 44 may be elongated to prevent its ability to easily go through the buttonhole 16. A length of the tether 40 from the clamp 18 to the distal end 42 may be less than 6.0 inches. An actuator 46 is mechanically coupled to the clamp 18. The actuator 46 is actuated to open the clamp 18 to release or receive the button 14. The actuator 46 may include a cable 48 attached to the jaws 22 and attached to a lever 50. The lever 50 is pivotally coupled to the handle 44. The cable 48 is pulled toward the handle 44 when the lever 50 is pivoted with respect to the handle 44 to pull the jaws 22 open as shown in FIG. 4.

In use the clamp 18 is extended through the buttonhole 16 and the button 14 is engaged with the clamp 18 while the tether 40 extends through the buttonhole 16. The tether 40 is then pulled, along with the clamp 18 and the button 14, through the buttonhole 16 so that the button 14 engages the shirt 12 adjacent to the buttonhole 16. The button 14 is then released from the clamp 18. It should be understood that the buttons 14 and buttonholes 16 may be found on the front of a shirt 12 or on the sleeves and cuffs.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A method of pulling a button through a buttonhole, said method including the steps of:

providing a shirt including said button and said buttonhole wherein the button and the buttonhole define a mated coupler;

providing a clamp configured for engaging said button;

providing a tether being attached to said clamp, said tether being a linked chain;

providing an actuator being mechanically coupled to said clamp, said actuator being actuated to open said clamp to release or receive the button;

extending said clamp through said buttonhole and engaging said button with said clamp while said tether extends through said buttonhole;

pulling said clamp and said button through said buttonhole; and releasing said button from said clamp.

2. The method according to claim 1, wherein the step of providing the clamp further includes said clamp including a base and a pair of jaws, each of said jaws having a first end and a second end, each of said first ends being pivotally coupled to said base, each of said second ends being movable towards or away from each other, each of said jaws having an arcuate shape extending from said first end to said second end such that said jaws form a closed loop when said second ends are abutted against each other, said second ends being biased towards each other.

3. The method according to claim 2, wherein the step of providing said clamp further includes each of said jaws comprising:

a first side, a second side, an outer edge and an inner edge, said outer edge having an elongated slot therein extending through said inner edge, said slot being configured to receive said button, said slot having a width between 0.1 inches and 0.2 inches.

4. The method according to claim 1, wherein the step of providing said tether further includes said tether having a distal end with respect to said clamp, a handle being attached to said distal end, a length of said tether from said clamp to said distal end being less than 6.0 inches.

5. A method of pulling a button through a buttonhole, said method including the steps of:

providing a shirt including said button and said buttonhole wherein the button and the buttonhole define a mated coupler;

providing a clamp configured for engaging said button, said clamp including a base and a pair of jaws, each of said jaws having a first end and a second end, each of said first ends being pivotally coupled to said base, each of said second ends being movable towards or away from each other, each of said jaws having an arcuate shape extending from said first end to said second end such that said jaws form a closed loop when said second ends are abutted against each other, said second ends being biased towards each other, each of said jaws including:

a first side, a second side, an outer edge and an inner edge, said outer edge having an elongated slot therein extending through said inner edge, said slot being configured to receive said button, said slot having a width between 0.1 inches and 0.2 inches;

providing a tether being attached to said clamp, said tether being a linked chain, said tether having a distal end with respect to said clamp, a handle being attached to said distal end, a length of said tether from said clamp to said distal end being less than 6.0 inches;

providing an actuator being mechanically coupled to said clamp, said actuator being actuated to open said clamp to release or receive the button;

extending said clamp through said buttonhole and engaging said button with said clamp while said tether extends through said buttonhole;

pulling said clamp and said button through said buttonhole; and releasing said button from said clamp.

* * * * *